US007425345B2

(12) United States Patent
Weber

(10) Patent No.: US 7,425,345 B2
(45) Date of Patent: Sep. 16, 2008

(54) APPARATUS AND METHOD FOR COATING OBJECTS USING AN OPTICAL SYSTEM

(75) Inventor: Jan Weber, Maple Grove, MN (US)

(73) Assignee: Boston Scientific Scimed, Inc., Maple Grove, MN (US)

( * ) Notice: Subject to any disclaimer, the term of this patent is extended or adjusted under 35 U.S.C. 154(b) by 141 days.

(21) Appl. No.: 10/790,115

(22) Filed: Mar. 2, 2004

(65) Prior Publication Data

US 2005/0196614 A1 Sep. 8, 2005

(51) Int. Cl.
*B05D 1/00* (2006.01)

(52) U.S. Cl. ..... 427/2.1; 427/2.24; 427/2.25; 427/2.26; 427/2.27; 427/2.28; 427/2.29; 427/2.3; 427/2.31

(58) Field of Classification Search ..... 427/2.1, 427/2.24, 2.25, 2.26, 2.27, 2.28, 2.29, 2.3, 427/2.31

See application file for complete search history.

(56) References Cited

U.S. PATENT DOCUMENTS

| | | | | |
|---|---|---|---|---|
| 3,710,279 | A | 1/1973 | Ashkin | |
| 5,079,169 | A | 1/1992 | Chu et al. | |
| 5,495,105 | A | 2/1996 | Nishimura et al. | |
| 5,752,606 | A | 5/1998 | Wilson et al. | |
| 6,055,106 | A | 4/2000 | Grier et al. | |
| 6,636,676 | B1 | 10/2003 | Renn | |
| 2002/0132315 | A1 | 9/2002 | Wang et al. | |
| 2002/0132316 | A1 | 9/2002 | Wang et al. | |
| 2003/0047688 | A1* | 3/2003 | Faris et al. | 250/432 R |
| 2003/0193984 | A1 | 10/2003 | Ozkan et al. | |
| 2004/0247777 | A1* | 12/2004 | Ringeisen et al. | 427/2.1 |

FOREIGN PATENT DOCUMENTS

| | | | |
|---|---|---|---|
| EP | 0 307 940 | A1 | 3/1989 |
| EP | 0 556 748 | A2 | 8/1993 |
| WO | WO98/24278 | A1 | 6/1998 |
| WO | WO99/54784 | A1 | 10/1999 |
| WO | WO 00/23825 | A2 | 4/2000 |
| WO | WO 02/09483 | A1 | 1/2002 |

OTHER PUBLICATIONS

Eriksen et al., "Fully dynamic multiple-beam optical tweezers," *Optics Express*, Jul. 15, 2002, vol. 10, No. 14.
McGloin et al., "Touchless tweezing," *spiess oemagazine*, Jan. 2003, pp. 42-45.

(Continued)

*Primary Examiner*—Erma Cameron
(74) *Attorney, Agent, or Firm*—Cooley Godward Kronish LLP

(57) ABSTRACT

An apparatus comprises a dispenser, a coherent energy source and an beam steering system. The dispenser defines a path of a droplet. The beam steering system is coupled to the coherent energy source and is configured to define a beam path of the coherent energy source. The beam path of the coherent energy source is disposable across the dispenser path at an interaction location. The beam steering system and coherent energy source are collectively configured such that at least one of a direction, a velocity and an acceleration of the droplet is modified within the interaction location.

16 Claims, 8 Drawing Sheets

OTHER PUBLICATIONS

Dholakia et al., "Optical tweezers: the next generation," *Physics World*, Oct. 2002, pp. 31-35.
McGloin et al., "Interfering Bessel beams for optical micromanipulation," *Optics Letters*, Apr. 15, 2003, vol. 28, No. 8, pp. 657-659.
Bechhoefer et al., "Faster, cheaper, safer optical tweezers for the undergrtaduate laboratory," *Am. J. Phys.*, vol. 70, No. 4, Apr. 2002, pp. 393-400.
"Introduction to Optical Tweezers," printed on Nov. 10, 2003, http://www.nbi.dk/~tweezer/introduction.htm, 5 pages.
"Optical Forces," Physik Weicher Materie, printed on Nov. 10, 2003, http://www.uni-leipzig.de/~pwm/kas/modul_opticalforces/theory.html, 6 pages.
Molloy et al., "Preface: Optical tweezers in a new light," *Journal of Modern Optics*, 2003, vol. 50, No. 10, 1501-1507.
Lang et al., "Resource Letter: LBOT-I: Laser-based optical tweezers," *Am. J. Phys.*, vol. 71, No. 3, Mar. 2003.
Grier, "A Revolution in Optical Manipulation," *Dept. of Physics, James Franck Institute and institute for Biophysical Dynamics*, May 15, 2003, pp. 1-10.
International Search Report for PCT Application No. PCT/US2005/000070, Jul. 6, 2005.
Written Opinion of the International Searching Authority for PCT Application No. PCT/US2005/000070, Jul. 6, 2005.
David J. Odde et al. "Laser-Guided Direct Writing of Living Cells" Biotechnology and Bioegineering, vol. 67, No. 3, Feb. 5, 2000, pp. 312-318.
European Examination Report mailed Oct. 18, 2007 for European Application No. 05-722-380.2, 7 pages.

* cited by examiner

APPARATUS AND METHOD FOR COATING OBJECTS USING AN OPTICAL SYSTEM

BACKGROUND

The invention relates generally to apparatus and method for coating objects using an optical system. For example, in one embodiment, an optical system is used to coat medical products such as a stent with biologically active substances.

Coating objects such as for example medical devices such as stents, with a substance such as for example a biologically active substance is a complex process because precise manipulation of the coating material is typically desirable. Such coating material can be, for example, deoxyribo nucleic acid (DNA), ribo nucleic acid (RNA), viruses or pharmaceutical substances. Because the typical costs of such coating materials are high, high processing yields are desirable.

Known coating processes, however, typically do not provide sufficient precision to produce high processing yield for such applications as coating medical devices with biologically active substances. Such known coating processes include, for example, spraying, dip-coating, fluidized-bed coating and electrostactic spraying. These known coating processes cannot precisely coat a device or product such that the size and chemical composition of each individual droplet or a collection of droplets being coated is controlled.

Thus, a need exists for a coating process having sufficient precision to result in high processing yields when coating products such as for example medical devices with a substance such as for example a biological active substance.

SUMMARY OF THE INVENTION

An apparatus comprises a dispenser, a coherent energy source and an beam steering system. The dispenser defines a path of a droplet. The beam steering system is coupled to the coherent energy source and is configured to define a beam path of the coherent energy source. The beam path of the coherent energy source is disposable across the dispenser path at an interaction location. The beam steering system and coherent energy source are collectively configured such that at least one of a direction, a velocity and an acceleration of the droplet is modified within the interaction location.

DETAILED DESCRIPTION

Figure 1:
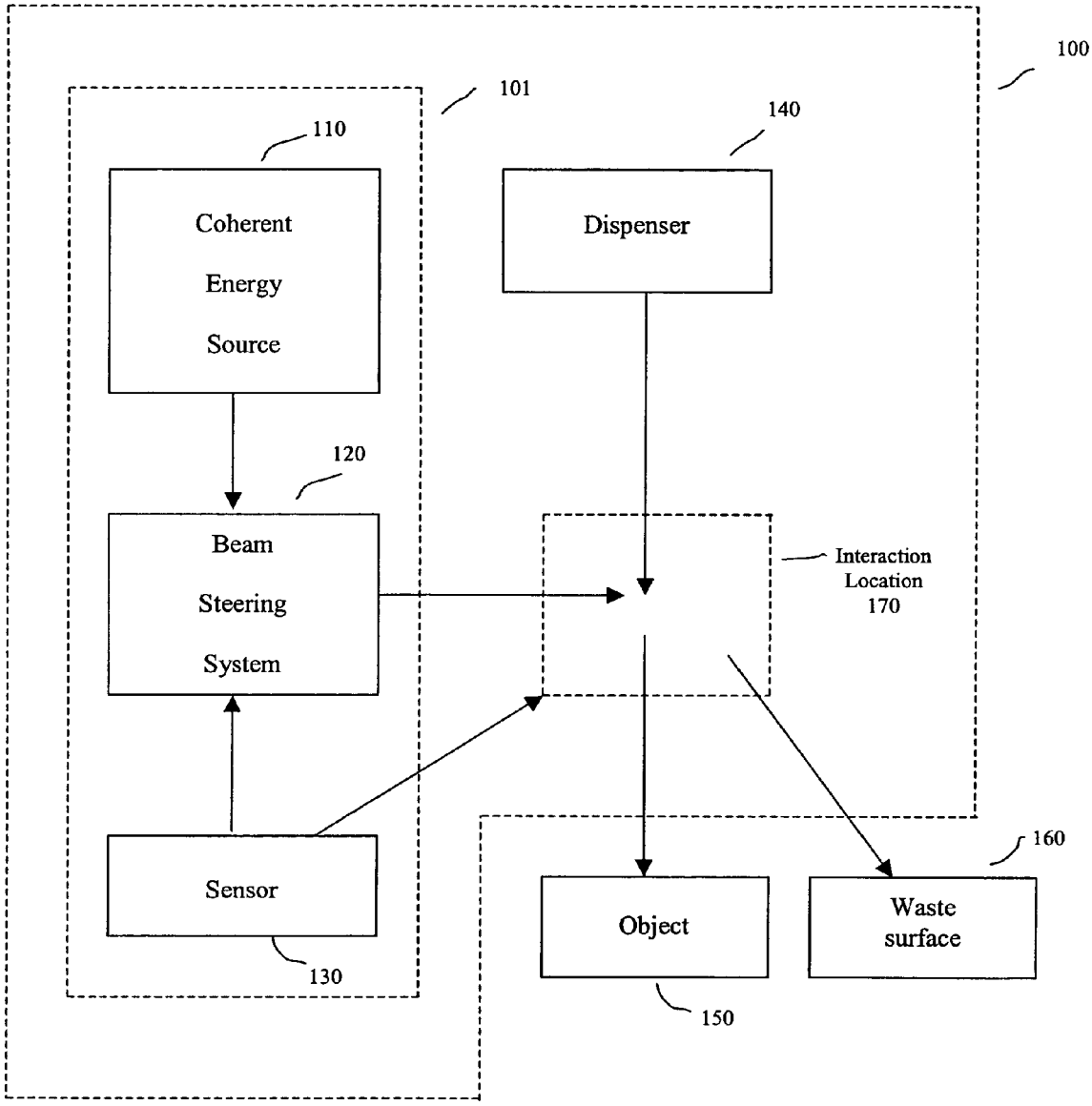
FIG. 1 shows a system block diagram of a coating system for coating an object, according to an embodiment of the invention.

In one embodiment, an object is coated by dispensing a droplet, measuring a characteristic of the droplet, modifying the direction, the velocity and/or the acceleration of the droplet using an optical system, and then disposing the droplet on a surface of the object. Such a process allows, for example, for the control of the size, weight, and/or the chemical composition of each individual droplet being used for coating. In other words, an optical system, such as for example a laser-based gradient-force optical system, can control the coating process on a per-droplet basis by controlling the direction, the velocity and/or the acceleration of each droplet for at least a portion in its flight path towards the object to be coated or a waste surface.

Generally speaking, in these laser-based gradient-force optical systems, a strongly focused beam of light has an intensity gradient directed towards the center of the beam. Small particles such as fluid droplets are drawn towards the focus of the beam (e.g., the beam center also referred to as the optical axis of the beam), while the beam's radiation pressure tends to direct the droplets down the optical axis of the beam. Under conditions where the gradient force of the beam exceeds the radiation pressure of the beam, the droplet can be trapped in three dimensions near the focal point of the beam.

Note that the droplets manipulated by laser-based gradient-force optical systems are not limited to droplets that are transparent to the optical beam. Rather, the laser-based gradient-force systems can be applied to droplets that are transparent, partially transparent or opaque to the optical beam.

Although the terms "optical tweezers" or "optical trap" are typically used to refer to optical systems that dispose small particles or droplets to a particular location within the optical beam, other systems are possible. In other words, techniques to modify the direction, the velocity and/or the acceleration of one or more droplets via coherent sources need not trap the droplets to a particular location within the optical beam. Rather, techniques contemplated herein can include modifying the direction, the velocity and/or the acceleration of one or more droplets, for example, via an interaction of the droplet and the light beam for only a portion of the flight path of the droplet. Such a portion of the droplet flight path is referred to herein as the interaction location.

By characterizing the droplets before being disposed on the surface of an object, the processing yield of a coating process can be improved. For example, the droplets can be pure polymer or a polymer dissolved in a solvent. Alternatively, a pure polymer can be dispensed from one dispenser and a solvent can be dispensed concurrently from another dispenser. These droplets can be measured and any droplets comprising, for example, a monomer can be directed to a waste surface, not the object, via the optical system. Once the solvent flashes off the object, a substantially pure polymer coating remains on the object. In other words, the coating remaining on the object can be substantially free of any undesired components such as, for example, a monomer component.

Note that the term object is herein generically to refer to the thing being coated. Such an object can be, for example, a medical device such as a stent. Alternatively, where the object is a medical device, the medical device can be any type of article or device used in a medical treatment or therapeutic setting where a coating is desirable.

The coating can include, for example, one or more therapeutic agents, therapeutic materials or active materials. As used herein, the terms "therapeutic agent," "therapeutic material," "active material," and similar terms includes, but is not limited to, any therapeutic agent or active material, such as drugs, genetic materials, and biological materials. Suitable genetic materials include, but are not limited to, DNA or RNA, such as, without limitation, DNA/RNA encoding a useful protein and DNA/RNA intended to be inserted into a human body including viral vectors and non-viral vectors. Suitable viral vectors include, for example, adenoviruses, gutted adenoviruses, adeno-associated viruses, retroviruses, alpha viruses (Semliki Forest, Sindbis, etc.), lentiviruses, herpes simplex viruses, ex vivo modified cells (e.g., stem cells, fibroblasts, myoblasts, satellite cells, pericytes, cardiomyocytes, skeletal myocytes, macrophage), replication competent viruses (e.g., ONYX-015), and hybrid vectors. Suitable non-viral vectors include, for example, artificial chromosomes and mini-chromosomes, plasmid DNA vectors (e.g, pCOR), cationic polymers (e.g., polyethyleneimine, polyethyleneimine (PEI)) graft copolymers (e.g., polyether-PEI and polyethylene oxide-PEI), neutral polymers PVP, SP1017 (SUPRATEK), lipids or lipoplexes, nanoparticles and microparticles with and without targeting sequences such as the protein transduction domain (PTD).

Suitable biological materials include, but are not limited to, cells, yeasts, bacteria, proteins, peptides, cytokines, and hormones. Examples of suitable peptides and proteins include growth factors (e.g., FGF, FGF-1, FGF-2, VEGF, Endotherial Mitogenic Growth Factors, and epidermal growth factors, transforming growth factor α and β, platelet derived endothelial growth factor, platelet derived growth factor, tumor necrosis factor α, hepatocyte growth factor and insulin like growth factor), transcription factors, proteinkinases, CD inhibitors, thymidine kinase, and bone morphogenic proteins (BMP=s), such as BMP-2, BMP-3, BMP-4, BMP-5, BMP-6 (Vgr-1), BMP-7 (OP-1), BMP-8. BMP-9, BMP-10, BMP-11, BMP-12, BMP-13, BMP-14, BMP-15, and BMP-16. Currently preferred BMP=s are BMP-2, BMP-3, BMP-4, BMP-5, BMP-6, and BMP-7. These dimeric proteins can be provided as homodimers, heterodimers, or combinations thereof, alone or together with other molecules. Cells can be of human origin (autologous or allogeneic) or from an animal source (xenogeneic), genetically engineered, if desired, to deliver proteins of interest at a desired site. The delivery media can be formulated as needed to maintain cell function and viability. Cells include, for example, whole bone marrow, bone marrow derived mono-nuclear cells, progenitor cells (e.g., endothelial progentitor cells), stem cells (e.g., mesenchymal, hematopoietic, neuronal), pluripotent stem cells, fibroblasts, macrophage, and satellite cells.

The term "therapeutic agent" and similar terms also includes non-genetic agents, such as: anti-thrombogenic agents such as heparin, heparin derivatives, urokinase, and PPack (dextrophenylalanine proline arginine chloromethylketone); anti-proliferative agents such as enoxaprin, angiopeptin, or monoclonal antibodies capable of blocking smooth muscle cell proliferation, hirudin, and acetylsalicylic acid, amlodipine and doxazosin; anti-inflammatory agents such as glucocorticoids, betamethasone, dexamethasone, prednisolone, corticosterone, budesonide, estrogen, sulfasalazine, and mesalamine; antineoplastic/antiproliferative/anti-miotic agents such as paclitaxel, 5-fluorouracil, cisplatin, vinblastine, vincristine, epothilones, methotrexate, azathioprine, adriamycin and mutamycin; endostatin, angiostatin and thymidine kinase inhibitors, taxol and its analogs or derivatives; anesthetic agents such as lidocaine, bupivacaine, and ropivacaine; anti-coagulants such as D-Phe-Pro-Arg chloromethyl keton, an RGD peptide-containing compound, heparin, antithrombin compounds, platelet receptor antagonists, antithrombin antibodies, anti-platelet receptor antibodies, aspirin (aspirin is also classified as an analgesic, antipyretic and anti-inflammatory drug), dipyridamole, protamine, hirudin, prostaglandin inhibitors, platelet inhibitors and tick antiplatelet peptides; vascular cell growth promotors such as growth factors, Vascular Endothelial Growth Factors (VEGF, all types including VEGF-2), growth factor receptors, transcriptional activators, and translational promotors; vascular cell growth inhibitors such as antiproliferative agents, growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents, vasodilating agents, and agents which interfere with endogenous vasoactive mechanisms; anti-oxidants, such as probucol; antibiotic agents, such as penicillin, cefoxitin, oxacillin, tobranycin; angiogenic substances, such as acidic and basic fibrobrast growth factors, estrogen including estradiol (E2), estriol (E3) and 17-Beta Estradiol; and drugs for heart failure, such as digoxin, beta-blockers, angiotensin-converting enzyme (ACE) inhibitors including captopril and enalopril.

Therapeutic materials include, for example, anti-proliferative drugs such as steroids, vitamins, and restenosis-inhibiting agents such as cladribine. Restenosis-inhibiting agents include, for example, microtubule stabilizing agents such as Taxol, paclitaxel, paclitaxel analogues, derivatives, and mixtures thereof. For example, derivatives suitable for use in the invention include 2'-succinyl-taxol, 2'-succinyl-taxol triethanolamine, 2'-glutaryl-taxol, 2'-glutaryl-taxol triethanolamine salt, 2'-O-ester with N-(dimethylaminoethyl)glutamine, and 2'-O-ester with N-(dimethylaminoethyl)glutamide hydrochloride salt. Other therapeutic materials include nitroglycerin, nitrous oxides, antibiotics, aspirins, digitalis, and glycosides.

FIG. 1 shows a system block diagram of coating system for coating an object, according to an embodiment of the invention. As shown in FIG. 1, the coating system 100 includes an optical system 101 and dispenser 140. Optical system 101 includes coherent energy source 110, beam steering system 120 and sensor 130. Coating system 100 can direct droplets for coating to either object 150 or optional waste surface 160.

More specifically, coherent energy source 110 is optically coupled to beam steering system 120, which directs the output of coherent energy source 110 into interaction location 170. Coherent energy source 110 can be any type of coherent energy source such as a continuous-wave laser having a coherence length, for example, at least equal to or greater than the path length between coherent energy source 110 and object 150, and between coherent energy source 110 and waste surface 160. The wavelength of the output of coherent energy source 110 can be any wavelength appropriate for the given coating material including a wavelength for which the given coating material is transparent, partially transparent or opaque to the energy output by coherent energy source 110.

Beam steering system 120 can include, for example, a gimbal and a gimbal-controlled mirror (also collectively referred to as a galvanic scanning mirror) (not shown) that alters the path of the beam output from coherent energy source 110. Beam steering system 120 can alter the beam path in, for example, one or two dimensions. Beam steering system 120 can include, for example, a processor-based system (not shown) that receive signals or instructions from sensor 130 and then controls the gimbal based on the received signals or instructions from sensor 130.

Sensor 130 can be any type of appropriate sensor that measures a given characteristic of the coating dispensed from dispenser 140. Sensor 130 can perform such measurements, for example, while the droplets dispensed from dispenser 140 are located within, before or beyond the interaction location 170. Sensor 130 can measure, for example, the size, direction, velocity, acceleration and/or chemical composition of the droplets. Sensor 130 can perform such measurements, for example, on a per-droplet basis or for a collection of droplets. Sensor 130 can be, for example, a fourier-transform infrared spectroscopy (FTIR) based sensor.

As mentioned above, beam steering system 120 can modify the direction, the velocity and/or the acceleration of droplets dispensed from dispenser 140 based on, for example, the signals or instructions received from sensor 130. The direction of the droplets can be modified such that the droplets are directed, for example, towards object 150 or waste surface 160. For example, in the case where a processor-based system associated with the beam steering system 120 determines that the droplet should be disposed on object 150 based on the signals or instructions received from sensor 130, beam steering system 120 can direct the droplet towards object 150. In the alternative case where the droplet should be disposed on waste surface 160, beam steering system 120 can direct the droplet towards waste surface 160. In sum, when a determination is made that a droplet is acceptable or unacceptable, the beam steering system 120 can direct the droplet to object 150 or waste surface 160, respectively. The determination on whether a droplet is acceptable or unacceptable can be, for example, based on a predetermined criterion based on a desired range of droplet size(s) and weight(s).

Another advantage of measuring and evaluating a droplet (s) before coating the object is that this droplet(s) can be disposed on a location the object in a highly tailored manner. More specifically, once a droplet(s) has been measured and evaluated as being appropriate for being disposed on the object, a specific location on the object can be selected based on, for example, the droplets that were previously disposed on the object, the preferred distribution of droplets on the object and the specific characteristics of the present droplet(s) In some embodiments, a composition of a droplet can be modified such that the composition of the droplet at a first position apart from a medical device is different from the composition when at a second position associated with a surface of the medical device. In some embodiments, a temperature of a droplet at the first position can be modified such that the temperature of the droplet when at the second position is increased or reduced to substantially correspond to a temperature of the medical device.

Dispenser 140 can be any type of appropriate system that dispenses one or more droplets of a coating substance at a given time. Dispenser 140 can include, for example, a valve-controlled processor-based system that can directly switch off and on the flow of the coating substance. One known system, MicroDrop by Microdrop GbmH, for example, allows the dispensing of droplets each having a volume of 30 to 500 pl, depending on the substance being dispensed.

As described above, the output of coherent energy source 110 can interact with one or more droplets dispensed from dispenser 140 within the interaction location 170 to modify the direction, the velocity and/or the acceleration of the one or more droplets. In embodiments where multiple droplets concurrently interact with the output of coherent energy source 110, the arrangement of the multiple droplets is referred to herein for convenience as a plume profile. Thus, the plume profile of the multiple droplets before interacting with the output of coherent energy source 110 can differ from the plume profile of the multiple droplets after interacting with the output of coherent energy source 110.

Coherent energy can be directed to modify the direction, the velocity and/or the acceleration of one or more droplets through a number of techniques. Such techniques include those based on, for example, laser-based gradient-force optical systems some of which are sometimes referred to as optical tweezers or optical traps. In these laser-based gradient-force optical systems, the motion of the droplet can be redirected and/or temporarily stopped.

In sum, the coating system shown in FIG. 1 can be configured in a number of different manners to implement various techniques to modify the direction, the velocity and/or the acceleration of one or more droplets via coherent sources. FIGS. 2 through 12 and their related description relate to these various configurations. The dimensions and relative sizes of the items shown in FIGS. 2 through 12 have been exaggerated for illustrative purposes and are not intended to be accurate in size or scale.

Figure 2:
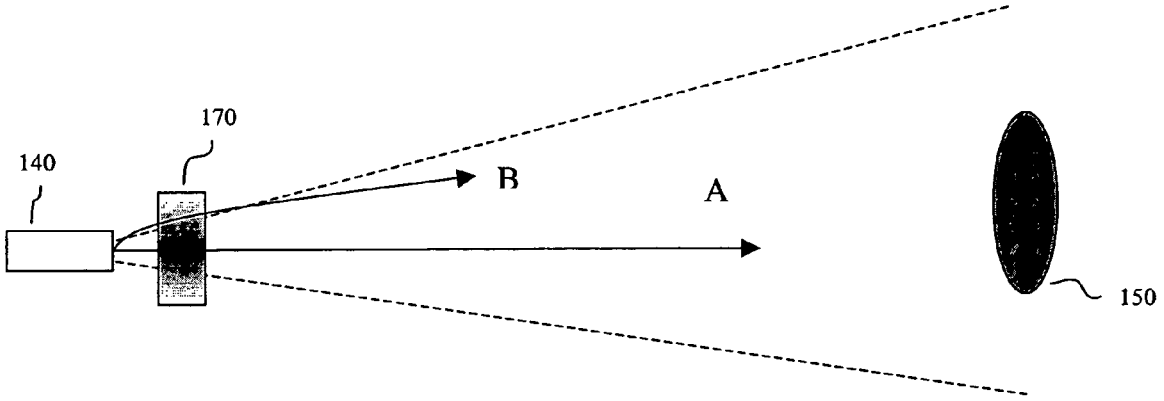
FIG. 2 shows a portion of the coating system shown in FIG. 1 where the output of the coherent energy source has a beam profile, according to an embodiment of the invention.
Figure 3:
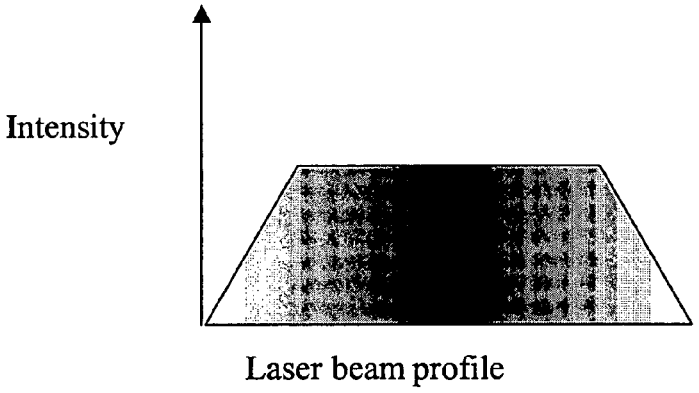
FIG. 3 shows an example of a coherent-energy-source beam profile for the portion of the coating system shown in FIG. 2.

FIG. 2 shows a portion of the coating system shown in FIG. 1 where the output of the coherent energy source has a beam profile shown in FIG. 3. As shown in FIG. 2, dispenser 140 dispenses droplets such as droplet A and droplet B. The droplets dispensed from dispenser 140 interact with the output of coherent energy source 110 via beam steering system 120 within interaction location 170. The direction, the velocity and/or the acceleration of the droplets is modified within the interaction location 170 such that the droplets are disposed on object 150 in a desired manner. In other words, through the control of beam steering system 120, the direction, the velocity and/or the acceleration of the droplets is modified such that the droplets can be disposed on object 150 as desired.

FIG. 3 shows an example of a profile beam within interaction location 170. As shown in FIG. 3, the intensity profile of the laser beam output from the beam steering system 120 has a Gaussian-like distribution where the peak of the beam intensity (indicated by the darkest shading) substantially corresponds to the beam center. Thus, the direction of the droplets within the interaction location 170 is modified towards the peak of the beam intensity at the beam center. For example, returning to FIG. 2, droplet B is displaced from the beam center more than droplet A. Consequently, the direction of droplet B modified towards the beam center more than the extent to which the direction of droplet B is modified. By controlling the position of the beam within the interaction location 170, the beam steering system 120 can control the manner in which a given droplet or droplets are disposed on the object 150.

Figure 4:
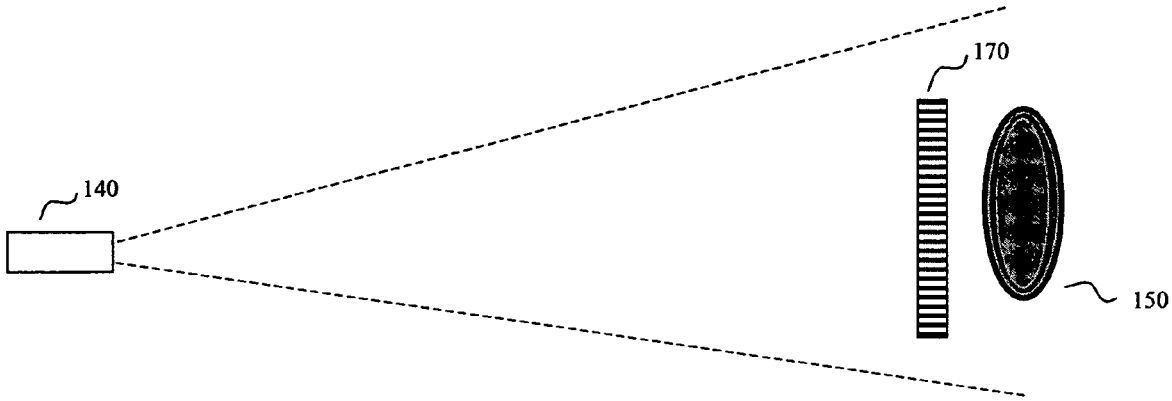
FIG. 4 shows a portion of the coating system shown in FIG. 1 where the output of the coherent energy source has a comb-like beam profile according another embodiment of the invention.
Figure 5:
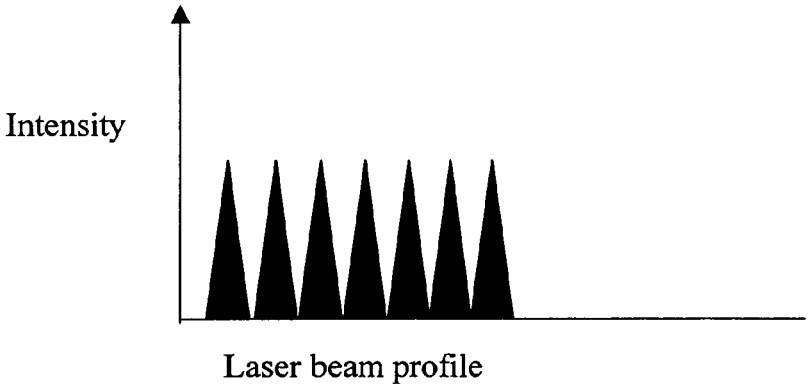
FIG. 5 shows an example of a coherent-energy-source beam profile for the portion of the coating system shown in FIG. 4.

FIG. 4 shows a portion of the coating system shown in FIG. 1 where the output of the coherent energy source has a comb-like beam profile according another embodiment of the invention. More specifically, FIG. 5 shows an example of a coherent-energy-source beam profile where the intensity profile of the laser beam output from the beam steering system 120 is a comb-like distribution having multiple peaks. In this case, the direction of the droplets within the interaction location 170 is modified towards the closest peak of the beam intensity. Although the coherent-energy-source beam profile shown in FIG. 5 has a one-dimensional structure with peaks along a single axis, in alternative embodiments the coherent-energy-source beam profile can have a two-dimensional structure with peaks along two axes.

This comb-like distribution of the coherent-energy-source beam profile can allow the combination of multiple coatings to be disposed on the object 150. For example, a first coating can be disposed on the object 150 when the beam profile is disposed within the interaction location 170 in a given orientation or position. Then, a second coating can be disposed on the object 150 when the beam profile is disposed within the interaction location 170 in a different orientation or position. An example of such an arrangement is shown in FIG. 6

Figure 6:
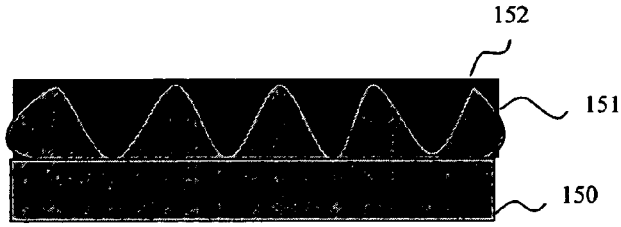
FIG. 6 shows a cross-sectional view of an object and its coatings, according to an embodiment of the invention.

More specifically, FIG. 6 shows a cross-sectional view of an object and its coatings, according to an embodiment of the invention. Here, a first coating 151 can be disposed on the object 150 when the beam profile is disposed within the interaction location 170 at a first orientation. In other words, the direction of droplets dispensed from dispenser 140 can be modified by beam output from the beam steering system 120 when the beam profile shown in FIG. 5 is in a given orientation.

Once the first coating 151 has been disposed on object 150, the orientation of the beam profile can be shifted or translated to a second orientation such that the peaks of the second orientation correspond to the valleys of the first orientation. Droplets associated with the second coating can be dispensed from dispenser 140. The direction of these droplets can be modified by beam output from the beam steering system 120 when the beam profile is in the second orientation, thereby disposing the second coating 152 on the object 150. This results in coating the surface of object 150 with a periodic variation between two coatings 151 and 152 in interleaving zones.

In alternative embodiments, different types of droplets can be used to coat an object. These different types of droplets can interact with the output of the coherent energy source differently thereby resulting in different coating of the object. FIGS. 7 through 11 are described below in connection examples of object coating using different types of droplets.

Figure 7:
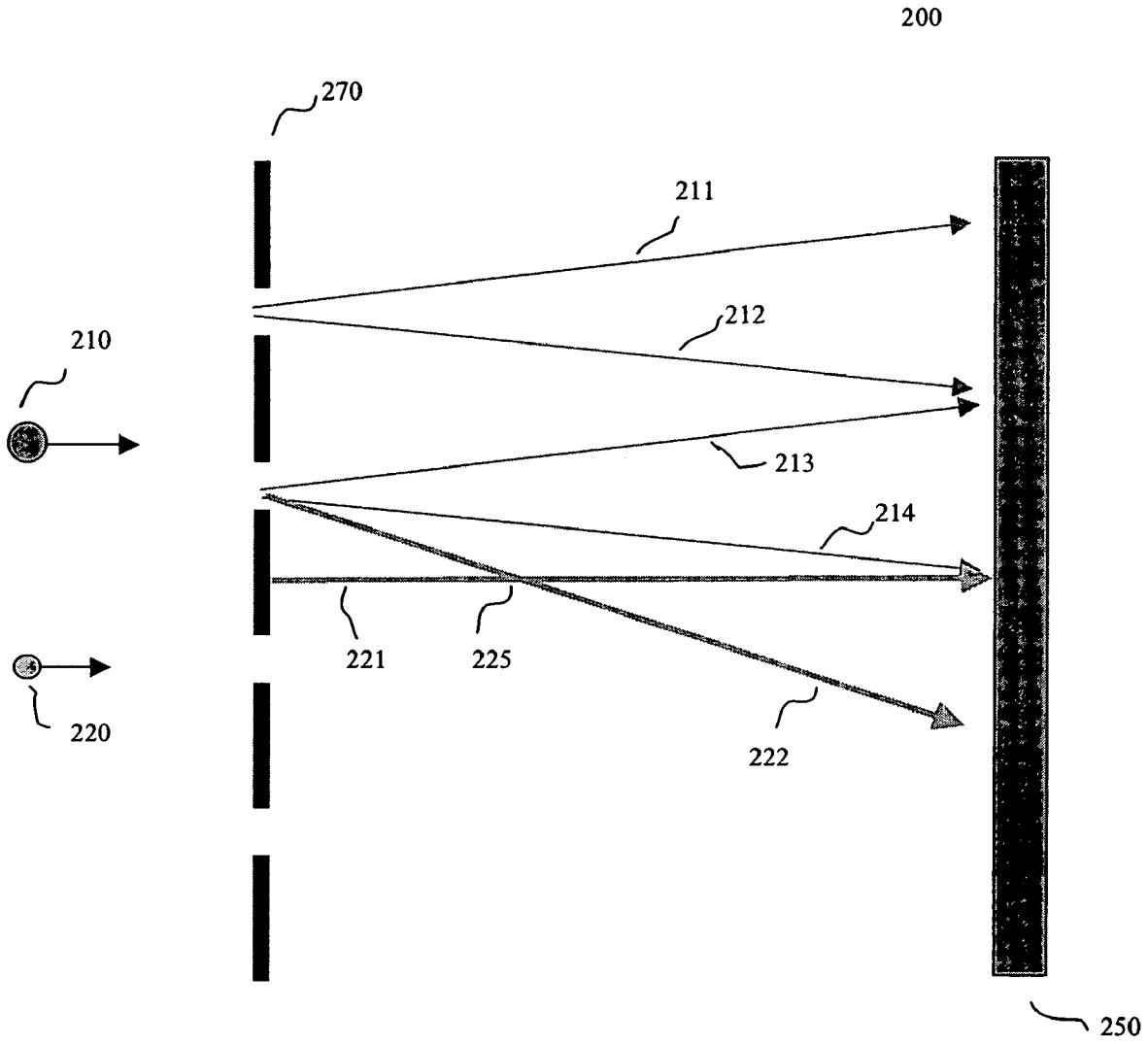
FIG. 7 shows an example of an object being coated with two different types of droplets, according to an embodiment of the invention.

FIG. 7 shows an example of an object being coated with two different types of droplets, according to an embodiment of the invention. As shown in FIG. 7, two different types of droplets 210 and 220 are dispensed concurrently. In particular, one dispenser (not shown in FIG. 7) dispenses droplet 210 while another dispenser (not shown in FIG. 7) dispenses droplet 220. Droplets 210 and 220 are different in the sense that they have differing optical characteristics such as a differing transmittance, mass, size, and/or index of refraction. Droplets 210 and 220 are shown as having different sizes, which are exaggerated for illustrative purposes.

Figure 8:
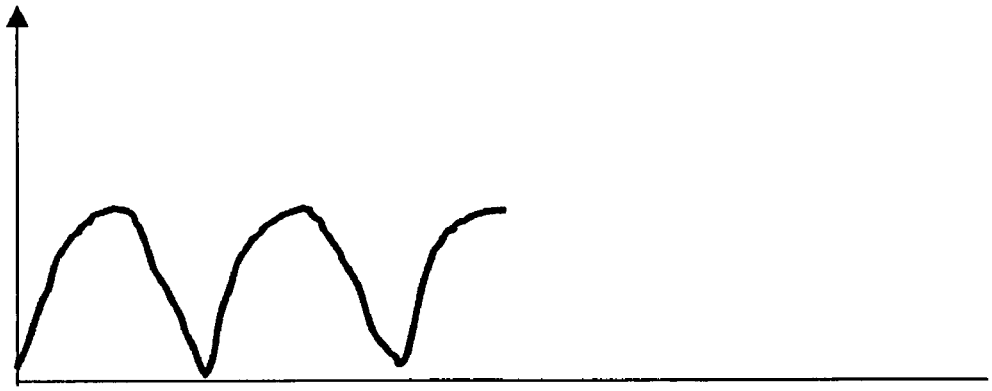
FIG. 8 shows an example of a profile beam within the interaction location, according to the embodiment shown in FIG. 7.

Droplets 210 and 220 interact with the output of the coherent energy source (not shown in FIG. 7) via a beam steering system (not shown in FIG. 7) within interaction location 270. FIG. 8 shows an example of a profile beam within the interaction location 270. As shown in FIG. 8, the intensity profile of the beam output from the beam steering system has multiple Gaussian-like distributions at periodic locations. Although FIG. 8 shows a beam profile in one dimension (e.g., an x-direction within an x-y plane) for illustrative purposes, the beam profile can have a two-dimensional profile. In such case, the beam profile in the y-direction can be, for example, similar to that in the x-direction. These different beam profiles can be formed, for example, by two coherent energy sources: one coherent energy source corresponding to the x-direction beam profile and another coherent energy source corresponding to the y-direction beam profile. These two coherent energy sources can be controlled, for example, by a single beam steering system or by two beam steering systems where each beam steering system controls a different coherent energy source.

Droplets 210 and 220 interact differently with the beam within interaction location 270 due to the different optical characteristics of droplets 210 and 220. For example, the beam within interaction location 270 can modify differently the direction of droplets 210 and the direction of droplets 220. As shown in FIG. 7, after interacting within interaction location 270, droplets 210 can have, for example, paths 211, 212, 213 and 214, and droplets 220 can have, for example, paths 221 and 222. For these examples, droplets 210 have focus points substantially at the surface of object 250 and droplets 220 have focus points away from object 250 such as focus point 225. Because the focus points of droplets 220 are away from object 250, droplets 220 are disposed on the surface of object 250 in a diffuse manner. In other words, after passing through their associated focus point, droplets 220 spread and are disposed on the surface of object 250 in a diffuse manner.

Figure 9:
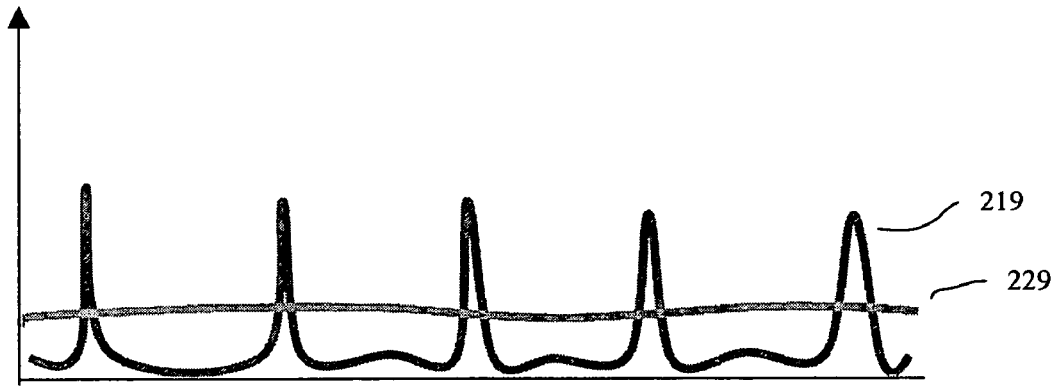
FIG. 9 shows an example of the coating distribution of the different droplets disposed on the object, according to the embodiment shown in FIGS. 7 and 8.

FIG. 9 shows an example of the coating distribution of droplets 210 and 220 disposed on the surface of object 250. In particular, distribution portion 219 is associated with droplets 210 and distribution portion 229 is associated with droplets 220. The comb-like structure of distribution portion 219 and the substantially uniform structure of distribution portion 229 are based on the different focus points for droplets 210 and 220, respectively. The comb-like structure forms interleaving zones. In other words, droplets 210 are disposed on the surface of object 250 in the substantially uniform structure of distribution portion 219 due to the diffuse manner in which droplets 210 impinge upon the surface of object 250 after being focused at locations away from object 250. Similarly, droplets 220 are disposed on the surface of object 250 in a comb-like manner due to their focus points being substantially at the surface of object 250.

Figure 10:
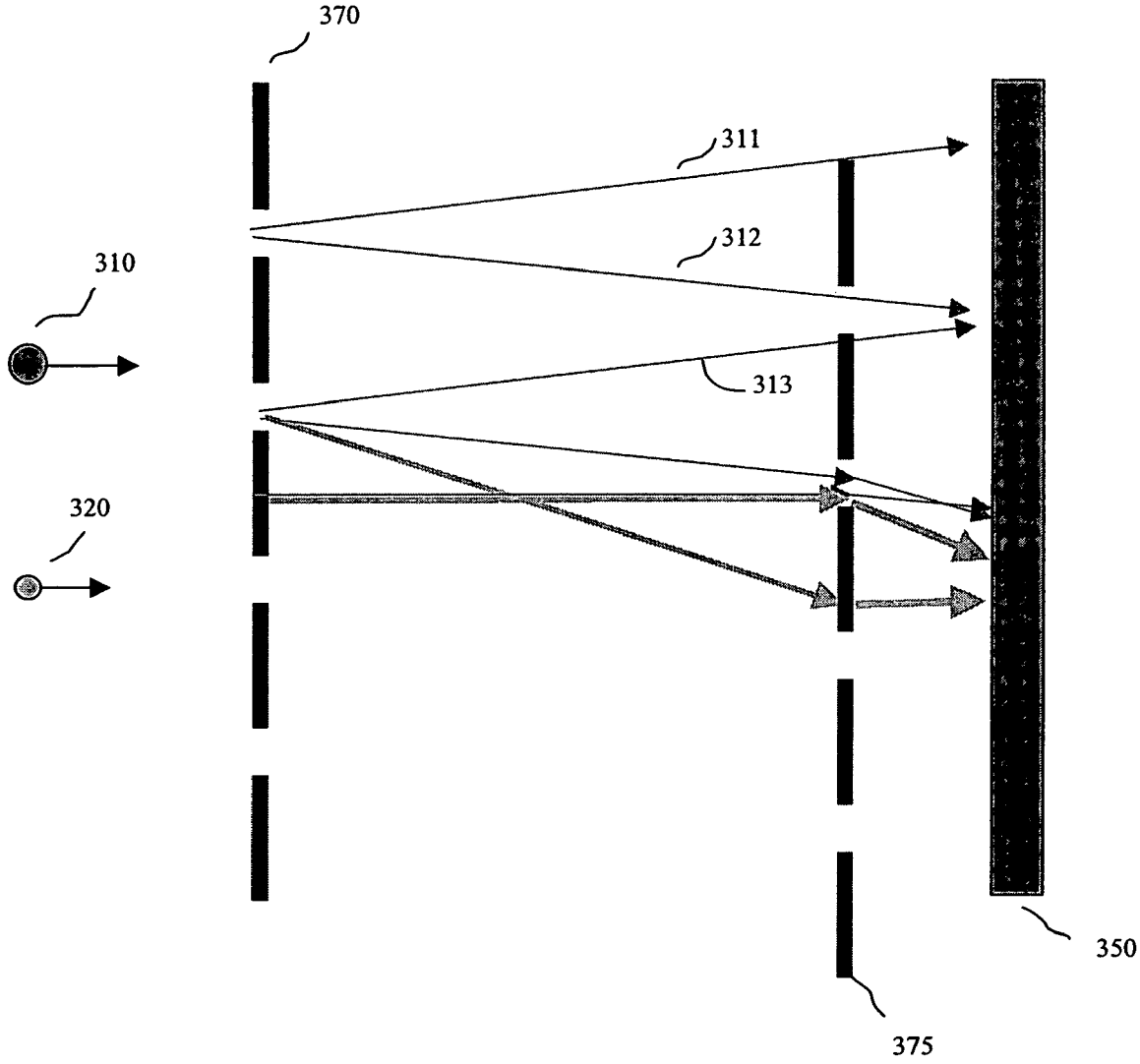
FIG. 10 shows another example of an object being coated with two different types of droplets, according to another embodiment of the invention.

FIG. 10 shows another example of an object being coated with two different types of droplets, according to another embodiment of the invention. As shown in FIG. 10, two different types of droplets 310 and 320 are each dispensed from a different dispenser (not shown in FIG. 10). Droplets 310 and 320 interact with the output of coherent energy sources (not shown in FIG. 10) via a beam steering system (not shown in FIG. 10) within interaction locations 370 and 375. The intensity profile of the beam within interaction locations 370 and 375 can be, for example, multiple Gaussian distributions at periodic locations.

In this embodiment, two interaction locations 370 and 375 are present, and the droplets 310 and 320 are dispensed at different times (i.e., not concurrently). Droplets 310 and 320 can interact within interaction location 370 in a manner similar to that described above in reference to interaction location 270 of FIG. 7. Interaction location 375 is disposed away from object 350 a shorter distance than that of interaction location 370. The combined affect of the beam within interaction locations 370 and 375 results in droplets 310 or droplets 320 being disposed on the surface of object 350 in a comb-like distribution.

For this embodiment, a first set of droplets such as droplets 320 can be disposed on the surface of object 350 via the interaction with the beam within interaction location 370 and 375. Then, the beam within interaction location 370 and 375 can be shifted a half wavelength of its comb-like distribution pattern. Subsequently, a second set of droplets such as droplets 310 can be disposed on object 350. The resulting coating distribution of droplets 310 and 320 disposed on the surface of object 350 is shown in FIG. 11.

Figure 11:
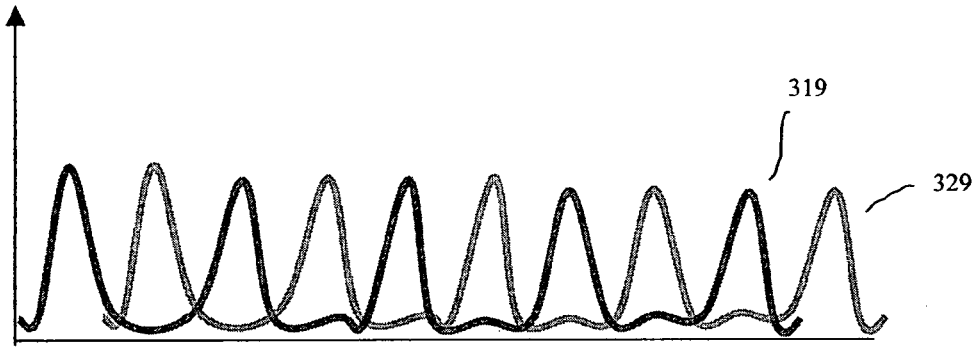
FIG. 11 shows an example of the coating distribution of the different droplets disposed on the object, according to the embodiment shown in FIG. 10.

As shown in FIG. 11, distribution portion 319 is associated with droplets 310 and distribution portion 329 is associated with droplets 320. Consequently, the peaks of the comb-like distribution pattern of droplets 310 are offset from the peaks of the comb-like distribution pattern of droplets 320 in interleaving zones. In other words, the peaks of the comb-like distribution pattern of droplets 310 are disposed on the surface of object 350 in substantial correspondence to the valleys of the comb-like distribution pattern of droplets 320 on the surface of object 350, and vice versa.

For embodiments using two or more types of droplets, including the embodiments described above in reference to FIGS. 7 and 10, the droplets can have, for example, different compositions and characteristics relating to their use as drugs. For example, the two types of droplets such as droplets 210 or 310 and 220 or 320 each can, for example, form a soft layer with a different type of drug. Such a soft layer can be, for example, a soft polymer with an embedded drug such as a styrene-isobutylene-styrene (SIBS) polymer. Alternatively, one type of droplet can be a soft polymer and the other type of droplet can be a hard polymer, where only one or alternatively where both layers contain a drug.

For such different droplet types having such different composition and drug characteristics, a given coating distribution pattern can result in a desired performance. For example, where the different droplet types have different drug release characteristics, the particular coating distribution pattern can result in a desired overall drug release characteristic. Following the examples of the coating distribution pattern shown in FIGS. 9 and 11, the drug release characteristics of the coating shown in FIG. 9 will differ from that of the coating shown in FIG. 11. For example, the drug release of the two droplet coatings 319 and 329 shown in FIG. 11 will be triggered at substantially the same time because an equal amount of the object surface is exposed with the two coatings. This is unlike FIG. 9 where an amount of the object surface exposed with the one type of coating 229 is greater than an amount of the object surface exposed with the other type of coating 219.

Figure 12:
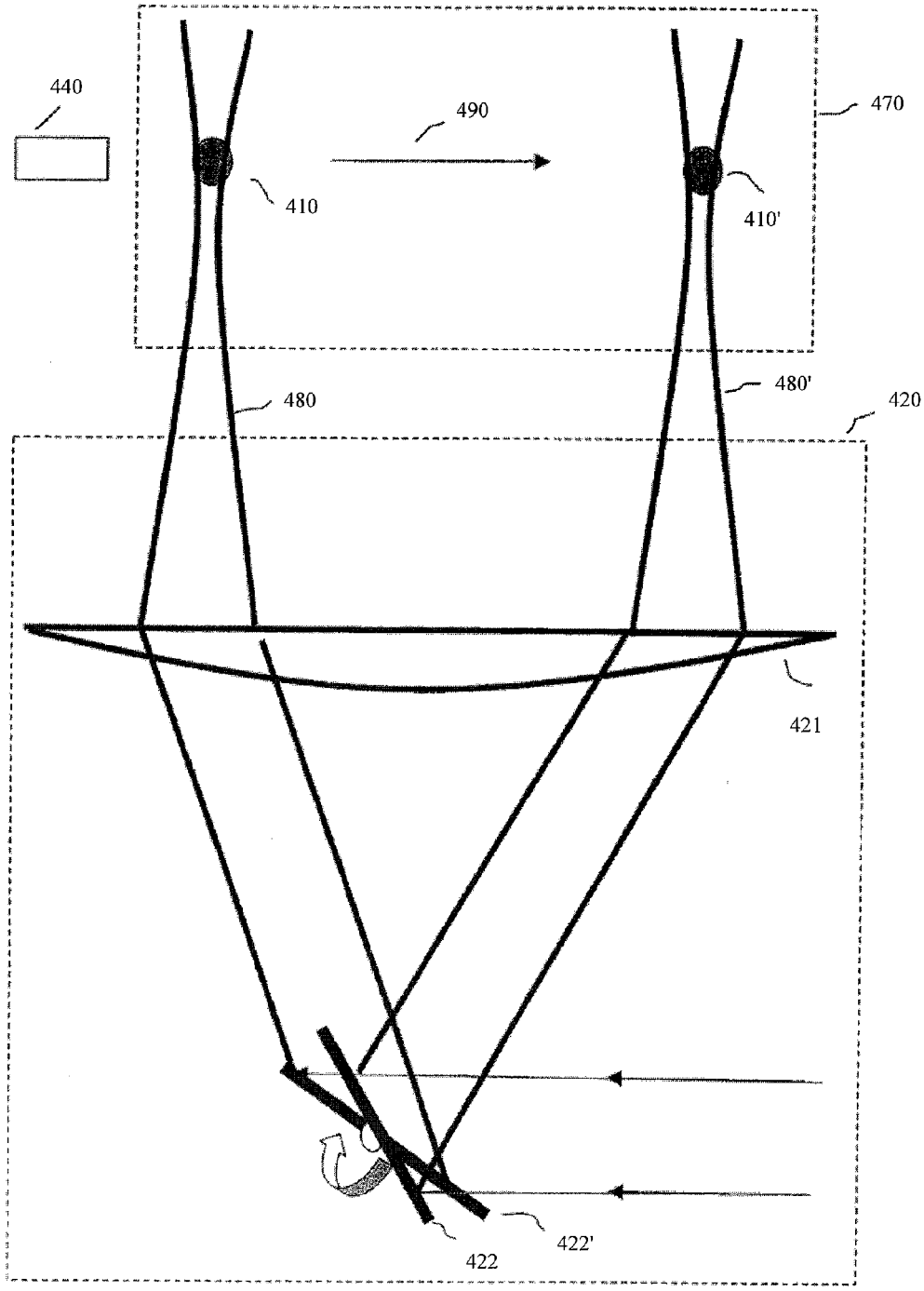
FIG. 12 shows a portion of a coating system for trapping a droplet, according to another embodiment of the invention.

FIG. 12 shows a portion of a coating system for trapping a droplet, according to another embodiment of the invention. As shown in FIG. 12, droplet 410 can be dispensed from dispenser 440. Droplet 410 has a flight path at least a portion of which transverses interaction location 470 and interacts with beam 480, which is the output of the beam steering system 420 within interaction location 470. The beam steering system 420 includes a lens 421 and a rotating mirror 422. Lens 421 can be, for example, a plano-convex lens having a plane of focus substantially corresponding to at least a portion of the flight path of droplet 410 within the interaction location 470. Rotating mirror 422 can be, for example, galvanic scanning mirror. Although not explicitly shown in FIG. 12, the coating system of FIG. 12 can include a coherent energy source, sensor, object, and waste surface similar to those described above in reference to FIG. 1.

FIG. 12 shows droplet 410, rotating mirror 422 and beam 480 at two different times, $t_1$ and $t_2$, where $t_2$ is after $t_1$. In particular, droplet 410 at $t_1$ and $t_2$ is indicated as droplet 410' and 410", respectively. Similarly, rotating mirror 422 at $t_1$ and $t_2$ is indicated as rotating mirror 422' and 422", respectively. Beam 480 at $t_1$ and $t_2$ is indicated as beam 480' and 480", respectively.

Droplet 410 after exiting dispenser 440 and beam 480 after exiting lens 421 are moving in direction 490 with a decreasing velocity until the droplet 410 is trapped and has a substantially zero velocity. More specifically, the rotating mirror 422 can be configured such that the initial scanning speed of beam 480 substantially matches the velocity of droplet 410 as it exits dispenser 440. The speed of beam 480 can then be reduced to a substantially zero velocity while continuing to trap the droplet 410 within the beam 480. In other words, the coating system partially shown in FIG. 12 acts as an optical tweezers or optical type of laser-based gradient-force system. The gradient force can be applied to the droplet 410 in a direction opposite of direction 490. This results in a reduction in the velocity of droplet 410 as it travels within the interaction location 470 in the direction 490. By reducing appropriately the scanning speed of beam 480 along direction 490, the applied gradient force can reduce the velocity of droplet 410 until it reaches a substantially zero velocity. Consequently, droplet 410 can be trapped in the focus of beam 480 in three dimensions.

Once trapped and stable in space, the droplet 410 can be moved towards the surface of the object or waste surface as desired. For example, droplet 410 once trapped can be moved using rotating mirror 420 and using optional scanning mirrors and lens (not shown). More specifically, droplet 410 can be moved along the x-dimension of direction 490 via rotating mirror 420. Droplet 410 can be moved along a z-dimension (i.e., orthogonal to direction 490 and out of the page) via an additional rotating mirror (e.g., a second galvanic scanning mirror) that allows movement of beam 480 along the z-dimension of lens 421. Droplet 410 can also be moved along a y-direction (i.e., orthogonal to direction 490 and within the page) via an addition lens to shift the focus of beam 480 in the y-dimension. In an alternative embodiment, holographic optical diffractors (not shown) can be used to control the movement of droplet 410 towards the surface of the object or waste surface as desired.

As mentioned above, rotating mirror 422 can be configured such that the initial scanning speed of beam 480 substantially matches the velocity of droplet 410 as it exits dispenser 440 and then the scanning speed of beam 480 can then be reduced to a substantially zero velocity while continuing to trap the droplet 410 within the beam 480. The following provides an example set of values for illustrative purposes.

A dispenser, such as the commercially available dispenser described above, can produce droplets having a substantially spherical shape with a volume of 30 to 500 pL at an exit velocity of less than 2.5 m/s. Such droplets can have, for example, DNA dissolved in water. For a droplet having a volume of 30 pL, the weight of the droplet is approximately 30 ng. The associated momentum, calculated as the mass multiplied by the velocity, for such a droplet as it exits the dispenser is 75 pN-s. Considering such a droplet away from the dispenser, the droplet can have, for example, a velocity of 1 m/s and an associated momentum of 30 pN-s.

When a beam engages the droplet at this location, the scanning speed of the beam can be reduced and the applied gradient force can reduce the velocity of droplet until it reaches a substantially zero velocity. Consider, for example, a coherent energy source that outputs a beam having 150 mW power can achieve 198 pN trapping force. Such a beam can reduce the droplet velocity to substantially zero within 0.152 seconds over a distance of 7.6 cm. In such a configuration, the beam steering system can have a performance such that it can decelerate the beam scanning speed from 1 m/s to 0 m/s within 0.152 seconds and over a distance of 7.6 cm, and then control movement of the particle to the surface of the object or the waste surface.

CONCLUSION

While various embodiments of the invention have been described above, it should be understood that they have been presented by way of example only, and not limitation. Thus, the breadth and scope of the invention should not be limited by any of the above-described embodiments, but should be defined only in accordance with the following claims and their equivalents.

The previous description of the embodiments is provided to enable any person skilled in the art to make or use the invention. While the invention has been particularly shown and described with reference to embodiments thereof, it will be understood by those skilled in the art that various changes in form and details may be made therein without departing from the spirit and scope of the invention.

What is claimed is:

1. A method, comprising:

dispensing a first plurality of droplets, the first plurality of droplets having a flight path;

modifying a direction of the first plurality of droplets along their flight path using a first optical field;

disposing the first plurality of droplets on a medical device after modifying the direction of the first plurality of droplets;

dispensing a second plurality of droplets, the second plurality of droplets having a flight path, a droplet from the second plurality of droplets having a size different from a size of a droplet from the first plurality of droplets, modifying the direction of the second plurality of droplets along their flight path using a second optical field; and disposing the second plurality of droplets on the medical device after modifying the direction of the second plurality of droplets such that the first plurality of droplets and the second plurality of droplets form interleaving zones in a plurality of coatings on the medical device.

2. The method of claim 1, wherein the dispensing associated with the first plurality of droplets includes dispensing toward the medical device along the flight path of the first plurality of droplets, the dispensing associated with the second plurality of droplets includes dispensing toward the medical device along the flight path of the second plurality of droplets.

3. A method, comprising:

dispensing a droplet, the droplet having a flight path;

modifying at least one of a direction, a velocity or an acceleration of the droplet along its flight path using an optical field, the modifying being based on a characteristic indicating that the droplet is unacceptable for disposing on a surface of a medical device; and disposing, after the modifying, the droplet on a waste surface different from and proximate to the surface of the medical device.

4. The method of claim 3, wherein the characteristic includes at least one of a size, a weight, the velocity, the direction, the acceleration, or a chemical composition of the droplet.

5. The method of claim 3, wherein the modifying includes modifying the velocity of the droplet to substantially zero temporarily at a position along the flight path.

6. The method of claim 3, wherein:

the droplet is included within a plurality of droplets;

the dispensing includes dispensing the plurality of droplets;

the modifying includes modifying the direction of at least two droplets from the plurality of droplets on a per-droplet basis using the optical field; and the disposing includes disposing the plurality of droplets on the waste surface after the modifying.

7. The method of claim 3, wherein:

the droplet is included within a plurality of droplets;

the dispensing includes dispensing the plurality of droplets, the dispensing of the plurality of droplets defines a first plume profile;

the modifying includes modifying the direction of the plurality of droplets based on a characteristic of the plurality of droplets indicating that the plurality of droplets is unacceptable for disposing on the surface of the medical device, the modifying defines a second plume profile different from the first plume profile, the characteristic of the plurality of droplets including at least one of a size, a weight, the velocity, the direction, the acceleration, or a chemical composition of the plurality of droplets; and the disposing includes the plurality of droplets having the second plume profile on the waste surface after the modifying.

8. The method of claim 3, wherein:

the optical field is a first optical field, the droplet is included within a first plurality of droplets, the dispensing includes dispensing the first plurality of droplets, the modifying includes modifying the direction of the first plurality of droplets using the first optical field based on a characteristic of the first plurality of droplets indicating that the first plurality of droplet is unacceptable for disposing on the surface of the medical device, the characteristic of the first plurality of droplets including at least one of a size, a weight, a velocity, the direction, an acceleration, or a chemical composition of the first plurality of droplets, the disposing includes disposing the first plurality of droplets on the waste surface after the modifying the direction of the first plurality of droplets, the method further comprising:

dispensing a second plurality of droplets, a droplet from the second plurality of droplets having a size different from the size of the droplet from the first plurality of droplets; and modifying the direction of the second plurality of droplets using a second optical field.

9. The method of claim 3, wherein the droplet is a first droplet, the method further comprising:

dispensing a second droplet at a time period at least a portion of which overlaps with a time period in which the first droplet is dispensed, the second droplet having a flight path;

modifying at least one of a direction, a velocity, or an acceleration of the second droplet along its flight path using the optical field based on a characteristic of the second droplet indicating that the droplet is unacceptable for disposing on the surface of the medical device, the characteristic of the second droplet including at least one of a size, a weight, the velocity, the direction, the acceleration, or a chemical composition of the second droplet; and disposing the second droplet on the waste surface after the modifying of the second droplet.

10. A method, comprising:

dispensing a first droplet toward a medical device along a first flight path;

modifying at least one of a direction, a velocity, or an acceleration of the first droplet using an optical field such that the first droplet moves along a second flight path outside of the optical field until the first droplet is disposed on a surface of the medical device, the second flight path being different than the first flight path;

dispensing a second droplet toward the medical device; and modifying at least one of a direction, a velocity, or an acceleration of the second droplet using the optical field such that the second droplet is disposed on a waste surface different from and proximate to the surface of the medical device.

11. The method of claim 10, wherein:

the modifying associated with the first droplet includes modifying the velocity of the first droplet to substantially zero temporarily.

12. The method of claim 10, wherein:

the first droplet is from a plurality of droplets;

the dispensing associated with the first droplet includes dispensing the plurality of droplets, the dispensing of the plurality of droplets defines a first plume profile; and the modifying associated with the first droplet includes modifying the direction of the plurality of droplets using the optical field, the modifying defines a second plume profile different from the first plume profile, the plurality of droplets having the second plume profile is disposed on the medical device after the modifying associated with the first droplet.

13. The method of claim 10, wherein the modifying associated with the first droplet is based on a measured characteristic of the first droplet, the measured characteristic of the first droplet is at least one of a size, a weight, a velocity or a chemical composition of the first droplet.

14. The method of claim 10, further comprising:

measuring at least one of the direction, the velocity, or the acceleration of the first droplet at a position along the first flight path, the second flight path being defined at least in part based on the measuring.

15. The method of claim 10, wherein a composition of the first droplet on the surface of the medical device differs from the composition of the first droplet after the dispensing.

16. The method of claim 10, wherein a temperature of the first droplet on the surface of the medical device is less than the temperature of the first droplet after the dispensing.

* * * * *